US005724771A

United States Patent [19]

Gipson

[11] Patent Number: 5,724,771

[45] Date of Patent: Mar. 10, 1998

[54] WINDOW ASSEMBLY WITH UNITARY ANTI-THEFT PROJECTION

[75] Inventor: Ronnie G. Gipson, Dearborn, Mich.

[73] Assignee: Excel Industries, Inc., Elkhart, Ind.

[21] Appl. No.: 624,131

[22] Filed: Mar. 29, 1996

[51] Int. Cl.[6] ..... E05B 55/00

[52] U.S. Cl. ..... 49/449; 49/413

[58] Field of Search ..... 49/449, 380, 413; 292/DIG. 47, DIG. 41, 240–242, 128

[56] References Cited

U.S. PATENT DOCUMENTS

| | | | |
|---|---|---|---|
| 3,808,742 | 5/1974 | Ehret et al. | 49/449 X |
| 3,893,261 | 7/1975 | Cribben | 49/449 |
| 4,124,054 | 11/1978 | Spretnjak | 49/413 X |
| 4,284,299 | 8/1981 | Kelly | 292/DIG. 46 X |
| 4,561,224 | 12/1985 | Jelens . | |
| 4,920,698 | 5/1990 | Friese et al. . | |
| 5,042,855 | 8/1991 | Bennett et al. . | |
| 5,442,880 | 8/1995 | Gipson . | |
| 5,473,840 | 12/1995 | Gillen et al. | 49/413 X |

*Primary Examiner*—Jerry Redman
*Assistant Examiner*—Curtis Cohen
*Attorney, Agent, or Firm*—Banner & Witcoff, Ltd.

[57] ABSTRACT

A modular sliding window assembly has a molded plastic frame comprising a molded plastic circumferential frame member and at least one molded plastic post segment within and unitary with the circumferential frame member. The frame defines primary and secondary apertures. A sliding pane having an inboard side and an outboard side is slidable from an open position to a closed position and the sliding pane closes the primary aperture when it moves to the closed position. The sliding pane is secured to the frame by a latch assembly which includes a latch which releasably engages a latch keeper. The latch can be fixedly attached to the sliding pane and the latch keeper made unitary with one of the frame, or, alternatively, the latch may be attached to the frame and the latch keeper may be attached to the sliding pane. Anti-theft means auxiliary to the latch keeper secure the sliding pane to the frame against inboard separation of the sliding pane from the frame. The anti-theft means has at least one anti-theft projection unitary with the frame. The projection restricts inboard motion of the sliding pane, preventing disengagement of the latch from the latch keeper and thereby denying unauthorized access through the window assembly. In certain preferred embodiments a pair of projections may be used. Each projection may optionally have an arc-shaped base segment and a laterally extending segment.

9 Claims, 2 Drawing Sheets

WINDOW ASSEMBLY WITH UNITARY ANTI-THEFT PROJECTION

FIELD OF THE INVENTION

The present invention is directed to window assemblies having a plastic molded frame and a sliding pane. In particular, the window assembly is provided with auxiliary anti-theft means to secure the sliding pane in a closed position in the window assembly and prevent unauthorized access through the window assembly.

BACKGROUND

Modular sliding window assemblies are known having a frame, at least one sliding pane and a latch assembly for securing the sliding pane to the frame. For example, one such recently developed modular sliding window assembly using a one-piece injection molded frame is shown in commonly owned U.S. Pat. No. 5,442,880 to Gipson et al. The frame is designed to work in cooperation with a backplate to create an elongate slide channel for a sliding window pane. The sliding pane is slidable from an open position to a closed position. A simple, low-cost latch is attached to the sliding pane. When the sliding pane moves to the closed position the latch moves into locking engagement with a latch keeper. However, in some designs sufficient force on the sliding pane may make it possible to disengage the latch from the latch keeper and gain unauthorized access to the vehicle.

It is an object of the present invention to provide a sliding window assembly with improved anti-theft features. It is a further object of the invention to provide a frame for a sliding window assembly having an anti-theft device. Additional objects and features of the invention will become apparent from the following disclosure taken together with the detailed discussion below.

SUMMARY

In accordance with a first aspect, a modular sliding window assembly has a molded frame comprising at least a circumferential frame member and at least on molded post segment. A sliding pane is slidable from an open position to a closed position. A simple, low-cost latch assembly having a latch and a latch keeper releasably secures the sliding pane to the frame when the sliding pane moves to the closed position. Anti-theft means auxiliary with the latch assembly secure the sliding pane to the frame against separation of the sliding pane from the frame. The anti-theft means has at least one anti-theft projection or finger provided unitary with the frame, that is, the projection and the frame are of one piece construction. In certain preferred embodiments the projection has a base segment extending inboard from the frame and a segment extending laterally from the base segment towards the sliding pane. When the sliding pane reaches the closed position the latch engages the latch keeper, the frame restricts outboard motion of the sliding pane and the anti-theft projections restrict inboard motion of the sliding pane. In certain alternative preferred embodiments, two or more of such projections may be used.

In accordance with a highly advantageous feature this design avoids the cost and complexity associated with the extra step in the assembly of a modular window assembly of adhesively bonding or bolting a separate pan to the frame to prevent the latch from disengaging the latch keeper when the sliding pane is biased in the inboard direction. Additional features and advantages of various preferred embodiments will be better understood in view of the detailed description provided below.

BRIEF DESCRIPTION OF THE DRAWINGS

Certain preferred embodiments are discussed below with reference to the appended drawings wherein.

Figure 1:
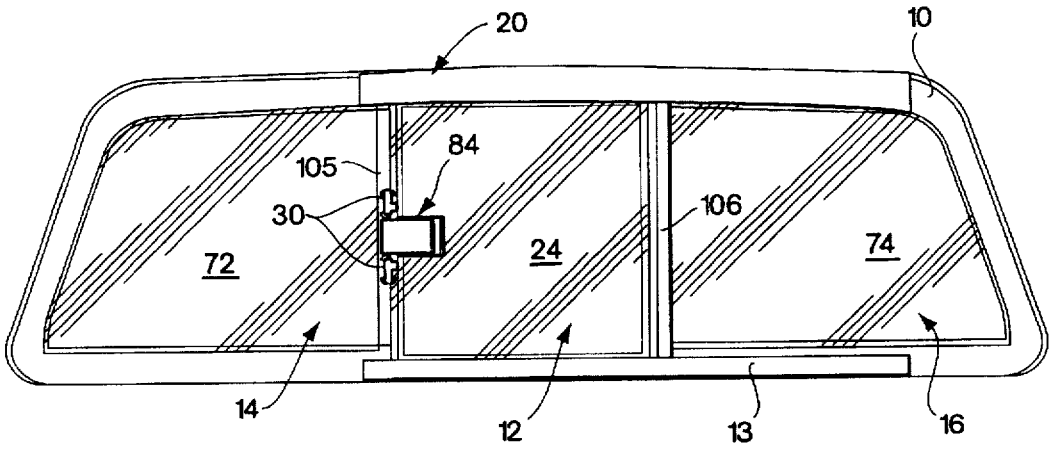
FIG. 1 is an elevation view of an inboard side of a sliding window assembly in accordance with a preferred embodiment.
Figure 2:
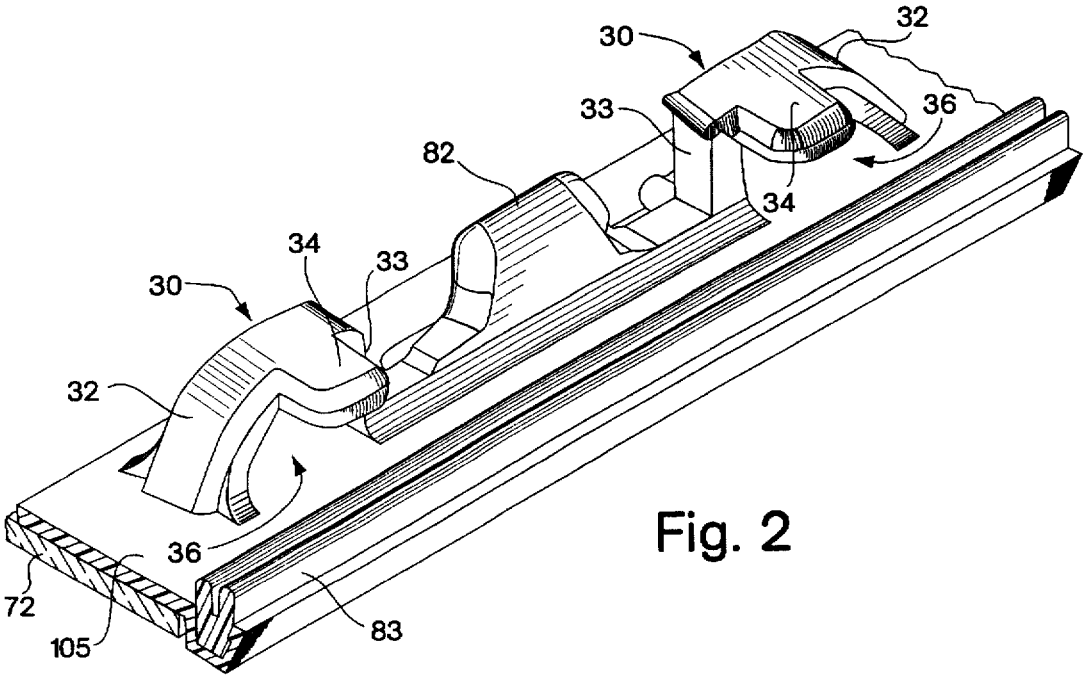
FIG. 2 is a exploded perspective view of the fingers and the latch in FIG. 1.

It should be understood that the appended drawings are not necessarily to scale, presenting a somewhat simplified representation of certain preferred embodiments illustrative of the basic principles of the invention. The specific design of window assemblies in accordance with the invention, including, for example, the specific configuration and dimensions of various components will be determined in part by the intended application and use environment. Certain features of the assembly have been enlarged or distorted relative to others to facilitate visualization and clear understanding. In particular, thin features may be thickened, for example, for clarity of illustration. All references to direction and position, unless otherwise indicated, refer to the orientation of the window assemblies illustrated in the drawings. In general directions to the right and left in the plane of the paper in FIG. 1 will be referred to as lateral directions. The directions normal to the plane of the paper in FIG. 1 are inboard/outboard. It should be understood that window assemblies in accordance with the invention can be used in diverse applications.

DETAILED DESCRIPTION OF CERTAIN PREFERRED EMBODIMENTS

The following discussion of certain preferred embodiments focuses on modular sliding window assemblies used in motor vehicles, but the design and operating principles are applicable generally to windows for numerous applications, including architectural window assemblies. For purposes of example and illustration, the modular window assembly disclosed in the drawings here is a backlite in a pickup truck. "Modular" window assemblies have been so widely incorporated into the automotive industry that the term "modular window assembly" has come to be used interchangeably with the term "window assembly" or even simply "window", meaning a pre-assembled unit prior to installation into the motor vehicle.

In the example disclosed herein, the frame and the backplate cooperate to form a run or slide channel for a sliding pane, however other frame designs may also incorporate the unitary anti- theft fingers. Referring now to the preferred embodiment of a modular sliding window assembly 20 depicted in the drawings, in FIG. 1 frame 10 comprises a molded plastic circumferential frame member and a pair of molded plastic post segments 105, 106 formed preferably within and unitary with the circumferential frame member. In the preferred embodiment of the frame shown in the drawings the post segments 105, 106 and the circumferential frame member define a primary aperture 12, and secondary apertures 14 and 16. It will be readily apparent to those skilled in the art that the frame may define at least one primary aperture, and optional secondary apertures. The frame 10 is preferably formed by injection molding a thermoplastic, for example Geloy thermoplastic available from General Electric Company. Fixed panes 72, 74 are preferably adhesively bonded to the frame 10 to seal the secondary apertures. A sliding pane 24, composed of glass or a transparent plastic and having an inboard side and an outboard side slides laterally from an open position to a closed position in frame track 13. The sliding pane 24 closes the primary aperture 12 at the closed position. Seals 83 may be used around the perimeter of the primary aperture 12 to produce a water tight seal and to reduce wind noise between the frame 10 and the sliding pane 24.

Figure 3:
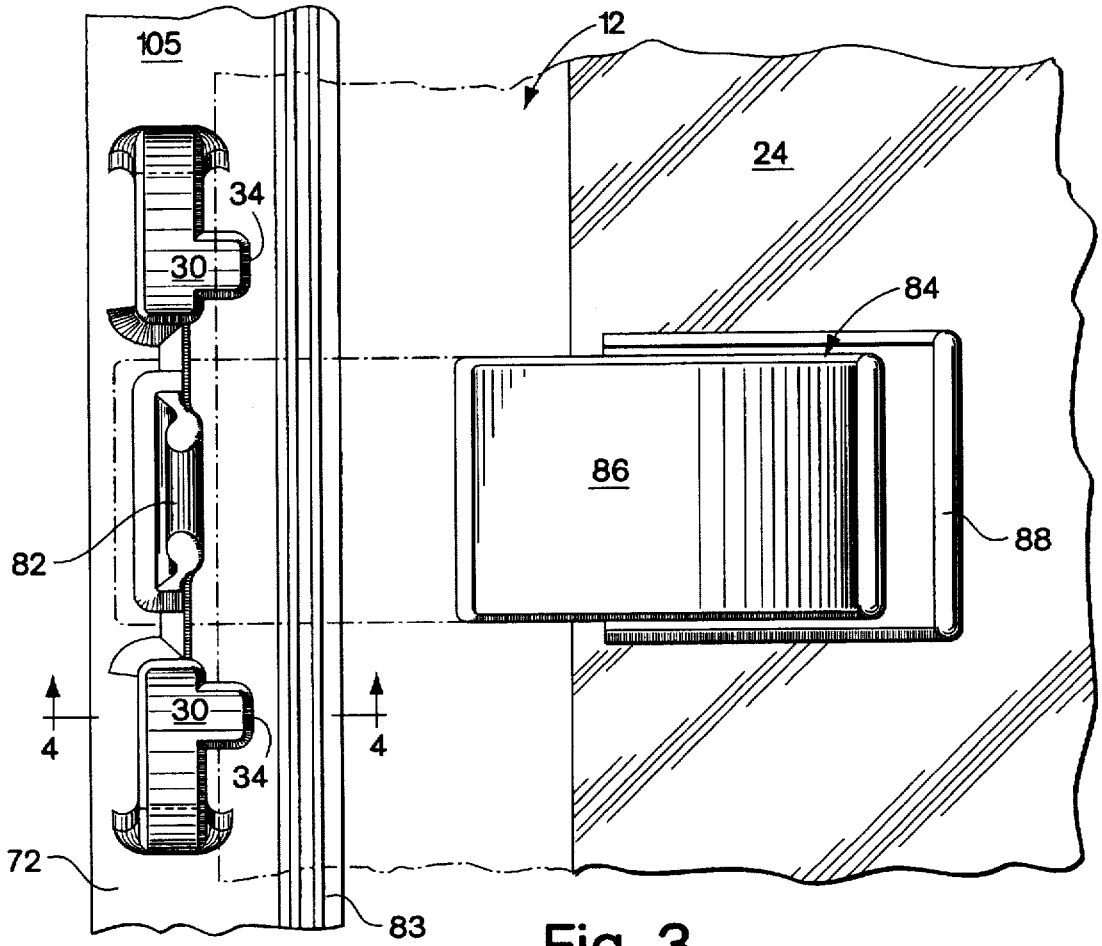
FIG. 3 is a side view of the sliding window assembly near the closed position focusing on the latch area.
Figure 4:
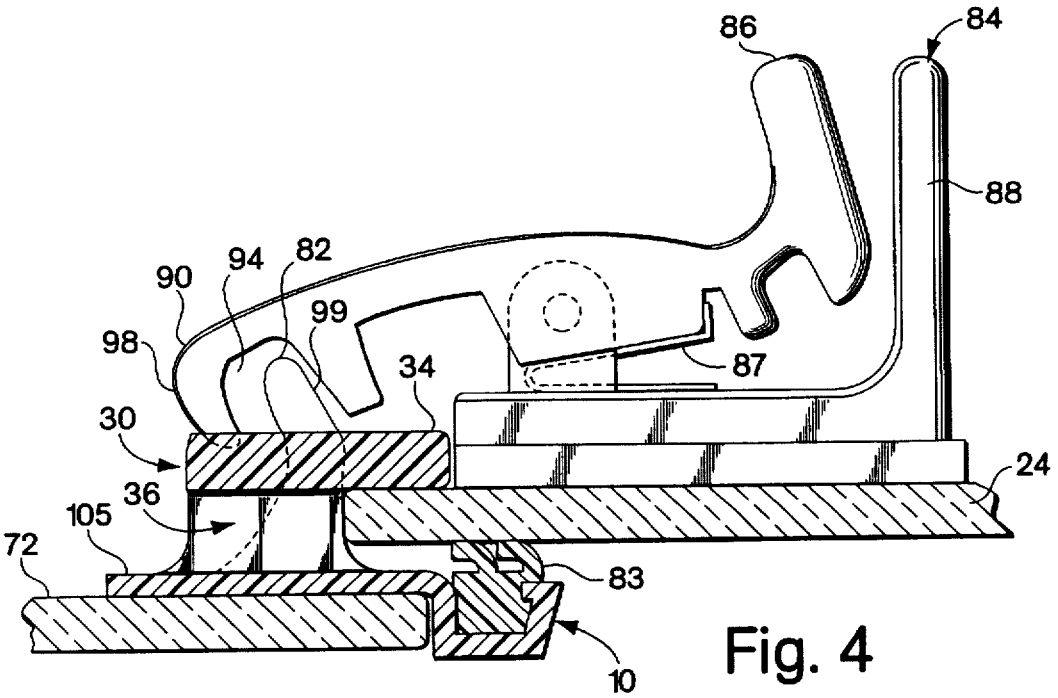
FIG. 4 is a cross sectional view of the fingers securing the sliding glass pane, taken along line 4—4 in FIG. 3.

A latch assembly comprising a latch 84 which releasably engages a latch keeper 82 is shown in FIGS. 3 and 4 to be of a simple, low-cost design. Latch 84 has a latch base 88 affixed to the inboard side of the sliding pane, a latch lever 86 pivotally attached to the latch base 88. A free end 90 of latch lever 86 forms a recess 94 and is biased by a latch spring 87 into locking engagement with a latch keeper 82. The latch keeper 82 is preferably mounted on post segment 105 of the frame and in certain preferred embodiments may be unitary with the frame, that is, the frame and the latch keeper are made as a one-piece construction. The spring 87 biases the free end 90 of latch lever 86 over the latch keeper and holds the sliding pane in the closed position. The free end 90 of the latch may have a beveled surface 98 that cooperates with a corresponding beveled surface 99 of the latch keeper 82 to automatically lift the latch lever 86 into the locking position upon moving the sliding glass 24 to its closed position. In certain preferred alternative embodiments, the latch keeper may be bonded or bolted to the sliding pane, and the latch may be attached to the sliding pane.

Without additional control, pressure on the outboard side of the sliding glass could in some instances cause the free end 90 of the latch lever to disengage the latch keeper 82. This would allow the sliding pane 24 to be moved to the open position, permitting unauthorized access through the primary aperture 12 into a motor vehicle interior compartment. In a highly advantageous feature of this invention, this problem is solved by the addition of anti-theft means auxiliary to the latch 84 and the latch keeper 82 securing the sliding pane 24 against inboard separation of the sliding pane 24 from the frame 10. At least one anti-theft projection or finger 30 is made unitary with the frame, that is the frame and the anti-theft projection 30 are made of a one-piece construction.

In the preferred embodiment shown in the drawings, a pair of anti-theft projections 30 are employed, each positioned adjacent one side of the latch keeper 82 on post segment 105 of frame 10. The projections 30 have a base segment 32 which is shown to be generally arc-shaped. The fingers have a laterally extending segment 34, and a hollowed opening 36. Upon sliding the sliding pane 24 to the closed position, the latch 84 lockingly engages the latch keeper 82. The edge of the sliding pane 24 slides into hollowed opening 36 underneath each lateral segment 34. The lateral segment 34 of the finger 30 overlays the inboard side of the sliding pane 24 and thereby prevents inboard movement or separation of the sliding pane 24 from the frame 10. Since the motion of the pane 24 is controlled on the outboard side by the frame 10 and on the inboard side by the projection 30 the latch 84 resists disengagement from the latch keeper 82 except upon pressure on the latch lever 86.

It is a significant cost advantage over known designs to incorporate such anti-theft fingers 30 and the latch keeper 82 into the frame 10 in a unitary design, thereby eliminating the need for other more complex anti-theft measures such as one or more separate pieces bolted or bonded to the post segment 105.

In accordance with known injection molding techniques to avoid warping and heat sink marks in a plastic material, the hollow opening 36 may extend through the arc-segment 32, and styling considerations may call for the arc-segment to have one side portion 33 of somewhat different angle with the post segment 105 and of somewhat different thickness from another side portion.

In view of the foregoing disclosure, those who are skilled in this area of technology will recognize that various modifications and additions can be made to the preferred embodiments discussed above without departing from the true scope and spirit of the invention. Those skilled in the art will recognize from this disclosure the suitability of other unitary anti-theft projection or finger designs and configurations which also secure the latch to the latch keeper and prevent unauthorized access to the vehicle. All such alternative embodiments are intended to be covered by the following claims.

What is claimed is:

1. A window assembly comprising, in combination:

a frame comprising a molded plastic circumferential frame member and at least one molded plastic post segment within and unitary with the circumferential frame member;

a sliding pane slidable from an open position to a closed position;

a latch assembly comprising a latch keeper positioned on one of the post segment and the sliding pane, and a latch attached to another of the post segment and the sliding pane, whereto the latch releasably engages the latch keeper to secure the sliding pane to the frame in its closed position; and anti-theft means resisting disengagement of the latch from the latch keeper by inboard displacement of the sliding pane in the closed position, wherein the anti-theft means comprises at least one anti-theft projection unitary with the post segment.

2. A window assembly comprising, in combination:

a frame comprising a molded plastic circumferential frame member and first and second molded plastic post segments which define two sides of a primary aperture, the post segments being positioned within and unitary with the circumferential frame member;

a sliding pane having an inboard side and an outboard side and slidable from an open position to a closed position, where the sliding pane closes the entire primary aperture in the closed position;

a latch assembly comprising a latch keeper positioned on one of the first post segment and the sliding pane, and a latch attached to another of the first post segment and the sliding pane, wherein the latch releasably engages the latch keeper to secure the sliding pane to the frame in its closed position; and at least one anti-theft projection unitary with the first post segment, extending from the first post segment in a lateral direction towards the sliding pane and overlaying the inboard side of the sliding pane in its closed position to resist inboard separation of the sliding pane away from the first post segment.

3. A window assembly comprising, in combination:

a frame comprising a molded plastic circumferential frame member and at least one molded plastic post segment within and unitary with the circumferential frame member;

a sliding pane having an inboard side and an outboard side, slidable from an open position to a closed position;

a latch keeper positioned on the frame;

a latch attached to the sliding pane, wherein the latch releasably engages the latch keeper to secure the sliding pane to the frame in its closed position; and a pair of anti-theft projections unitary with the frame, extending from the frame in a lateral direction towards the sliding pane, positioned adjacent the latch keeper, to restrict movement of the sliding pane and resist disengagement of the latch from the latch keeper.

4. The window assembly of claim 3 wherein the frame comprises a pair of molded plastic post segments which define two sides of a primary aperture, and the sliding pane closes the primary aperture when the sliding pane is in the closed position.

5. The window assembly of claim 3 wherein the latch comprises a latch base fixedly attached to the sliding pane, a latch lever pivotably attached to the latch base and a spring biasing the latch lever into locking engagement with the latch keeper.

6. The window assembly of claim 5 wherein the latch lever has a beveled surface which cooperates with a beveled surface of the latch keeper to automatically lift the latch lever into locking position upon moving the sliding pane to the closed position.

7. The window assembly of claim 3 wherein the latch keeper is unitary with a post segment of the frame.

8. The window assembly of claim 3 wherein the unitary anti-theft projection has an arc-shaped base segment and a laterally extending segment to captivate the sliding pane in an inboard direction as the sliding pane moves to its closed position.

9. A frame for a modular sliding window assembly comprising, in combination:

a molded plastic circumferential frame member and at least a pair of post segments within and unitary with the circumferential frame member, wherein the post segments and the circumferential frame member define at least a primary aperture;

a latch keeper formed unitary with a post segment of the frame for cooperating with a latch fixedly attached to a sliding pane for releasably engaging the latch keeper to secure the sliding pane to the frame; and a pair of anti-theft projections formed unitary with one of the post segments of the frame, positioned adjacent the latch keeper and extending laterally towards the primary aperture controlling inboard motion of a sliding pane and resisting disengagement of a latch from the latch keeper in a closed position.

* * * * *